US005584306A

United States Patent [19]

Beauman et al.

[11] Patent Number: 5,584,306

[45] Date of Patent: Dec. 17, 1996

[54] RECONSTITUTED TOBACCO MATERIAL AND METHOD OF ITS PRODUCTION

[76] Inventors: Emory Beauman, 3501 Redwood Ct., Quinton, Va. 23141; Patrick Cowling, 4607 Black Oak Rd., Richmond, Va. 23237; Diane L. Leister, 4200 Carafe Dr., Richmond, Va. 23234; Roy H. Roope, 6339 Elkhardt La., Richmond, Va. 23224

[21] Appl. No.: 336,438

[22] Filed: Nov. 9, 1994

[51] Int. Cl.[6] ..... A42B 15/18

[52] U.S. Cl. ..... 131/370; 131/335; 131/372

[58] Field of Search ..... 131/355, 370, 131/372, 374

[56] References Cited

U.S. PATENT DOCUMENTS

| | | | |
|---|---|---|---|
| Re. 24,424 | 2/1958 | Samfield et al. . | |
| 2,708,175 | 5/1955 | Samfield et al. . | |
| 2,769,734 | 11/1956 | Bandel et al. . | |
| 2,887,414 | 5/1959 | Rosenberg et al. . | |
| 3,213,858 | 10/1965 | Merritt et al. . | |
| 3,951,155 | 4/1976 | Prouse et al. . | |
| 3,983,884 | 10/1976 | Detert et al. . | |
| 4,140,135 | 2/1979 | Godfrey, Jr. . | |
| 4,144,894 | 3/1979 | Schmidt et al. . | |
| 4,176,668 | 12/1979 | Fiore et al. . | |
| 4,182,349 | 1/1980 | Selke . | |
| 4,542,755 | 9/1985 | Selke et al. . | |
| 4,564,031 | 1/1986 | Egri . | |
| 4,646,764 | 3/1987 | Young et al. . | |
| 4,681,126 | 7/1987 | Strubel et al. . | |
| 4,702,264 | 10/1987 | Graves, Jr. . | |
| 4,724,850 | 2/1988 | Graves, Jr. . | |
| 4,730,629 | 3/1988 | Grave, Jr. . | |
| 4,754,767 | 7/1988 | Graves, Jr. . | |
| 4,768,527 | 9/1988 | Graves, Jr. . | |
| 4,787,402 | 11/1988 | Leonard . | |
| 4,880,018 | 11/1989 | Graves et al. | 131/355 X |
| 4,889,143 | 12/1989 | Pryor et al. . | |
| 4,962,774 | 10/1990 | Thomasson et al. . | |
| 4,987,906 | 1/1991 | Young et al. . | |
| 5,007,440 | 4/1991 | Robinson et al. . | |
| 5,099,864 | 3/1992 | Young et al. . | |
| 5,143,097 | 9/1992 | Sohn et al. . | |

FOREIGN PATENT DOCUMENTS

| | | |
|---|---|---|
| 1716467 | 7/1969 | Australia . |
| 0056308A1 | 7/1982 | European Pat. Off. . |
| 0162671A3 | 11/1985 | European Pat. Off. . |
| 0535834A1 | 4/1993 | European Pat. Off. . |
| 1216945 | 4/1960 | France . |
| 62-264 | 6/1987 | Japan . |
| 61-247367 | 3/1988 | Japan . |
| 909273 | 10/1962 | United Kingdom . |
| 1055445 | 1/1967 | United Kingdom . |
| 1157574 | 7/1969 | United Kingdom . |
| 2087214A | 5/1982 | United Kingdom . |
| 127450 | 9/1985 | WIPO . |

*Primary Examiner*—Jennifer Bahr

*Attorney, Agent, or Firm*—Charles E. B. Glenn; James E. Schardt; Kevin B. Osborne

[57] ABSTRACT

Reconstituted tobacco sheet having improved homogeneity and wet and dry tensile strength are produced by a process including mixing a water-soluble polysaccharide and a humectant under a first high shear; subjecting the resulting aqueous binder composition to a second high shear mixing operation; mixing the resulting aqueous binder composition with tobacco dust under a third shear, the third shear being lower than the first and second shears to form a slurry; casting the slurry onto a supportive surface such as a stainless steel conveyor belt; drying the cast slurry to form a reconstituted tobacco sheet; and recovering the reconstituted tobacco sheet for use such as cut filler for cigarettes.

46 Claims, 1 Drawing Sheet

RECONSTITUTED TOBACCO MATERIAL AND METHOD OF ITS PRODUCTION

FIELD OF INVENTION

The present invention relates to reconstituted tobacco materials and their manufacture, and more particularly to a method of producing reconstituted tobacco sheet from a binder material.

BACKGROUND OF INVENTION

Tobacco dust is a by-product of tobacco processing and generally comprises minute tobacco particles created by tobacco breakage wherever tobacco is dropped, rolled, rubbed, tumbled, or impinged. Extremely fine tobacco dust is produced at leaf stemmery plants, whose dust has had so little utility in the trade that it has earned the nickname "stemmery discard".

Generally, practices have arisen to employ tobacco dust in conjunction with other tobacco-products, such as stem pieces and leaf scraps in the preparation of a reconstituted tobacco material. Heretofore, these practices did not operate well with stemmery discard.

A known process for making reconstituted tobacco sheet includes grinding tobacco stem together with a portion of tobacco dust; placing the mixture in a solution of diammonium phosphate (DAP) and ammonia; holding the solution in a tank for several hours until the diammonium phosphate and ammonia chemically release the natural pectins from the tobacco particles; and casting the resultant slurry onto a moving belt. The released pectins chemically bind the tobacco particles as the cast slurry is dried and then cut. This type of process may suffer difficulties if the original tobacco feed stock does not include a substantial portion of tobacco particles ladened with natural pectins. Some forms of tobacco fines from stemmery discard may be deficient in this regard when attempted with this type of (DAP) process.

The inclusion of DAP in the process of making this form of reconstituted tobacco creates a characteristic subjective note to this product. Also, interest has arisen to produce reconstituted sheet with as few added ingredients as possible, and this process is not operative without the addition of DAP.

A second type of process incorporates paper making techniques in the construction reconstituted tobacco sheet. The process begins with the extraction of soluble fractions of incoming tobacco feed stock and forming the insoluble products (comprising mostly fiber) into a slurry for production of a base-web in accordance with paper making practices. At the same time, the soluble fractions are concentrated and recombined with the base-web to form a final coated sheet. This process requires a high percentage content of stemmed particles in the composition so as to achieve sufficient fiber content for the paper making portion of the process. Extremely fine tobacco particles in the tobacco stock is problematic in that it readily passes through the fourdrinier wire and oftentimes finds its way into the white-water of the paper making facility.

Yet another genre of processes for constructing reconstituted tobacco sheet material includes those which attempt sheet construction by the addition of a binder material in solution with finely ground tobacco. Such processes are disclosed U.S. Pat. No. 2,769,734 to Bandel. In Bandel, tobacco is dry ground and then commingled with a preparation of water and adhesive, whereupon the tobacco is extruded onto an endless moving surface, dried and rolled into tobacco sheet. The process in Bandel is primarily directed to forming a self supporting tobacco sheet such as a cigar wrapper which preferably includes a film forming agent. The examples provided in the patent to Bandel include a portion of wood pulp fiber. The presence of wood pulp in the construction of reconstituted sheet can render a "papery" note to its smoke.

Tobacco sheet constructed from the DAP process provide a just adequate tensile strength of approximately 15 kilograms per meter. Tobacco sheet constructed from the paper-making technique has improved tensile strength of about 50 kilograms per meter, but such is dependent upon the inclusion of fiber in the laid slurry and is not workable with a 100% tobacco dust content sheet strength is an important parameter, because the stronger sheet will provide statistically longer strand lengths and will suffer less breakage (and less re-creation of dust).

OBJECTS AND SUMMARY OF THE INVENTION

An object of the present invention is to provide a process for making a reconstituted tobacco sheet, wherein only a minimum of ingredients are employed.

Another object of the present invention is to provide a method of constructing reconstituted tobacco sheet, which provides a sheet having improved homogeneity, tensile strength and subjectives, even at elevated content of tobacco fines.

Still another object of the present invention is to provide a process for making a reconstituted tobacco sheet which can employ tobacco fines, yet achieve improved tensile strength.

Yet another object of the present invention is to provide a process for making a reconstituted tobacco sheet with a polysaccharide binder, wherein the sheet has sufficient strength and subjective character to be utilized as a component of cut filler in a blended cigarette.

These and other objects achieved by the present invention which provides a process for making a reconstituted tobacco sheet (or "cast leaf"), which process comprises preparing an aqueous binder solution by mixing water and a water-soluble polysaccharide binder under a first high shear mixing action sufficient to disperse and initiate hydration of the polysaccharide binder and subjecting the resulting binder dispersion from the first high shear mixing step to a second high shear mixing treatment sufficient to more completely hydrate the polysaccharide binder molecules so as to enhance the binding potential of the resultant aqueous binder solution (hereinafter "shear-treated binder solution"). The method further comprises mixing a supply of minute tobacco particles with the shear-treated binder solution and commingling same using a low shear mixing technique, wherein the low shear mixing is at a shearing load less than the shearing action employed into preparation of the shear-treated binder solution. The resultant slurry is then cast onto a supportive surface such as an endless steel belt conveyor, whereupon it is dried and removed from the supportive device.

With such practices, a reconstituted tobacco sheet is formed which provides significantly improved tensile strength over reconstituted tobacco constructed in accordance with the prior art and lacking the second shear treatment of the binder solution.

Another aspect of the present invention includes cooling the aqueous binder solution during the application of the second shear so that a fuller hydration of the binder is achieved without thermal degradation of the binder.

Additionally, practices in accordance with the present invention provides a satisfactory reconstituted tobacco sheet, even at extreme or elevated levels of tobacco dust, even with reduced or little stem content. The sheet may also be constructed with minimal ingredient content.

BRIEF DESCRIPTION OF THE DRAWING

The above described features and advantages of the present invention and its other objects, aspects, and advantages will become apparent upon a reading of the following detailed description in reference to the drawing, in which.

DETAILED DESCRIPTION OF THE PREFERRED EMBODIMENT

Figure 1:
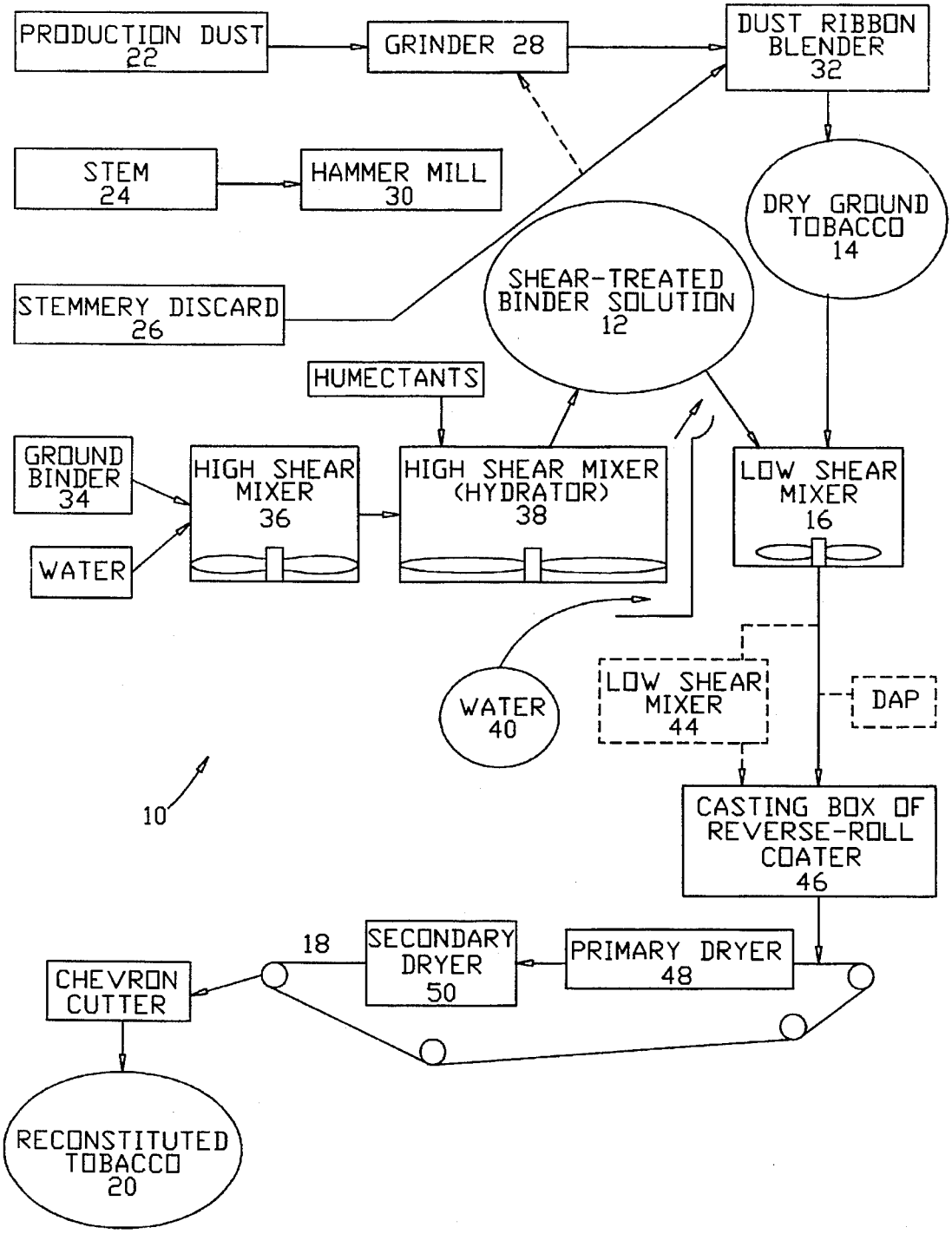
FIG. 1 is a block diagram of a process in accordance with a preferred embodiment of the present invention for making a novel reconstituted tobacco sheet.

Referring to FIG. 1, a preferred embodiment of the present invention comprises a process generally designated as 10 wherein a shear-treated binder solution 12 is commingled with minute particles of dry ground tobacco 14 at a low shear mixer 16 and cast upon a stainless steel belt 18, whereupon it is dried and cut to form a reconstituted tobacco sheet, material 20.

The preparation of the dry ground tobacco particles 14 initiates with the sourcing from the various types of tobacco by-products such as production dust 22, surplus stem 24 and/or stemmery discard 26, the latter-most form of tobacco by-product being extremely minute, usually 400 mesh size or smaller. Production dust 22 is usually collected at and about operational facilities of cigarette manufacturers and is produced wherever tobacco is dropped, rolled, rubbed, tumbled, or impinged at various production machinery stations. The production dust 22 is directed to a tobacco grinder 28 which is configured to grind the pieces of production dust 22 to a mean particle size in the range of 80 mesh to about 400 mesh, and more preferably from about 80 mesh to about 200 mesh. The fine particle size enhances interaction between the tobacco particles 14 and the shear-treated binder solution 12 as they are commingled at the low shear mixer 16.

With regard to the term "mesh", mesh values reflect the ability of more than 95% of the tobacco particles of a given mesh size to pass through a screen of a given mesh value. In that connection, mesh values reflect the number of mesh holes for each square inch of screen.

With regard to pieces of stem, preferably Burley stem because of their general availability in the industry, the stem 24 is first directed to a hammer mill 30 as a preparatory step before its being directed into the grinder 28 either separately or together with the production dust 22. The stemmery discard 26 is a by-product of threshing operations at leaf stemmery facilities. The tobacco particles of this by-product is usually extremely fine, usually too fine for use in papermaking styled techniques for manufacturing reconstituted tobacco of the prior art. Tobacco particles comprising stemmery discard 26 are usually of such size that they may not need to be directed through the grinder 28 before being mixed at a dust ribbon blender 32 with the other components. In the alternative it may be directed instead to the grinder 28 as with the other by-product components.

Usually stemmery discard 26 initially includes elevated amounts of soil and/or sand, which may be cleaned and separated using techniques such as is taught in U.S. Pat. No. 5,263,569 (PM 1689), which is herein incorporated by reference in its entirely.

A machine for executing the grinding function of the grinder 28 is a Williams Roller Mill System, but could be any other type of equipment that will reduce particle size to at least 80 mesh or finer.

It is to be realized that the present process 10 may be operated with either the dry ground production dust 22, stem 24 or stemmery discard 26, either alone or in combination, so long as the tobacco particles comprising the dry ground tobacco 14 are reduced to the preferred mesh size of at least 80 to about 200 mesh or finer. At such point, the dry ground tobacco 14 is ready for being commingled with the shear-treated binder solution 12 at the Io w shear mixer 16.

Preparation of the shear-treated binder solution 12 begins preferably with sourcing a ground binder, preferably in the form of guar gum. Any other water-soluble polysaccharide that are usable in tobacco and/or food applications might be employed instead, including fruit pectin, citrus pectin, tobacco pectin, hydroxyethyl guar gum, hydroxypropyl guar gum, hydroxyethyl locust bean gum, hydroxypropyl locust bean gum, alginate, starch, modified starch, derivitized starch, methyl cellulose, ethyl cellulose, ethylhydrosymethyl cellulose, hydroxymethyl cellulose, carboxymethyl cellulose, tamarind gum, dextran, pullalon, konjac flour, xanthan gum, and mixtures thereof. Guar gum, however, is particularly preferred.

Preparation of the shear-treated binder solution 12 begins with dispersing the dry ground binder 34 in water with the assistance of a high shear mixture 36 to a degree sufficient to achieve uniform dispersion of the binder 34. Hydration of the binder may initiate, but the action at this first high shear mixer 36 is configured as a preparatory step, i.e. achieving dispersion, prior to the next step where hydration is brought to completion. Preferably the water is introduced at a temperature in the range of ambient to 170° F., but more preferably in the range of 120° to 140° F.

With a fast hydrating guar gum such as TIC 8A22 or Aqualon Supercol G2, agglomeration of the guar can be prevented by metering the water and the ground binder (powdered guar) into the mixer 36, while the mixer 36 is activated, at constant rates proportional to the desired solids content of the solution. Usually, with fast hydrating materials, by the time the time the tank is full and/or within 10 minutes to 1 hour, the dispersion of the ground binder will have progressed sufficiently to then proceed with the next step of treating the dispersion at the second high shear mixer 38.

However, with a slow hydrating guar, such as TIC-SCM or Aqualon-Supercol G3, optionally, one may add guar as above or fill the first high shear mixer 36 with water and then activate the high shear mixer 36 adding the guar incrementally. The slow hydrating guar will require extended residence time in the first high shear mixer 36 in the range of 0.5 hours to 2 hours to assure uniform/complete dispersion.

With either type of guar gum, the high shear mixer 36 should be operated sufficiently to transform the initial viscosity of the guar dispersion from initial values of less than 1 poise, when guar and water are first combined, to a condition where the dispersion achieves an apparent viscosity of between 2 and 100 poise at a solids content of 1% to 3% by weight and more preferably at about 1.5% to 1.8% by weight with an apparent viscosity of between 2 and 6 poise.

The average shear rate at the first high shear mixer 36 should be set at 100 to 500 reciprocal seconds or approximately 100 to 300 when using guar gum. At the discharge of the first mixer, the dispersion is preferably at a temperature of approximately ambient to 140° F., and more preferably approximately 120° F., but should not be allowed to exceed 170° F.

The output of the first mixer 36 is directed immediately into a second high shear mixer (or hydrator) 38 to maximize hydration of the binder molecules so as to enhance the binding potential of the dispersed guar. The average rate of shear at the second high shear mixer 38 should be set at a value greater than that of the first high shear mixer 36, because the second high shear mixer 38 is effecting hydration, whereas the first high shear mixer 36 is preferably operated in a manner that assures uniform dispersion. The average shear rate at the second high shear mixer 38 should be set in the range of approximately 510 to 1000 reciprocal seconds, more preferably about 600 to 900 reciprocal seconds, or more preferably, 600 to 800 reciprocal seconds when using guar gum.

With the fast hydrating guar, residence time at the second high shear mixer 38 may be as brief as 30 minutes; whereas with the slower hydrating guars, residence time may extend from 1 to 5 hours, but is preferably at least approximately 2 to 3 hours. The second high shear mixer 38 is operated sufficiently to bring the apparent viscosity to approximately 20 to 60 poise. At the same time, measures are taken to maintain a relatively low temperature in the guar during operation of the second mixer 38. Preferably, a stream 40 of coolant (water) is directed through a cooling jacket 42 at the second high shear mixer 38 to maintain temperature control during this step of the process. Preferably, the temperature of the guar solution in the second mixer 38 is maintained between approximately 120° F. and 140° F. and no higher than 170° F. so as to avoid thermal cleaving of the hydrated guar molecules.

If significantly lesser shear rates than those described above were to be applied at the second high shear mixer 38, then viscosities would tend to climb to unacceptably high values at the second high shear mixer 38 (possibly as high as 140 poise), because of the hydrated state of the guar. The average shear rates at the mixer 38 are elevated to values as described above so that viscosities are not allowed to climb excessively and so that the magnitude of shearing action does not physically degrade the guar polymers.

Preferably the guar solution is hydrated at the second mixer 38 using a high shearing device such as a Ross mixer or a dual, high performance impeller in a tank with adequate horsepower to provide the necessary revolutions per minute. Such dual impellers may be sourced from Lightnin of Rochester, N.Y.

Not wishing to be bound by theory, it is believed that operation of the second mixer 38 assures a more complete hydration of the guar particles, which unravels its molecular structure and thereby presents a proportionally greater number of bonding sites for cooperation with tobacco particles. Whatever chemical and/or physical phenomenon may be operative, data is presented in the discussion which follows, which data shows significant advantage in executing this addition high shear mixing of the binder solution over processes attempting the preparation of a binder solution with resort to only a single mixer.

At the high shear mixer 38, it is at the option of the operator to add a humectant such as glycerin to the binder solution at or near the end of operation of the hydration, preferably at amounts in the range of what would become 2 to 4% by a dry weight basis of the final sheet. Although glycerine is preferred, propylene glycol or mixtures of glycerine and propylene glycol or any other humectant which is acceptable for use in the tobacco industry might be employed instead. The process is not dependant upon the addition of humectants, and it is preferably to operate with as little as possible.

At this point, the hydrated binder solution discharged from the second high shear mixer 38 is now in condition for being commingled with the dry ground tobacco particles 14 so as to form a homogeneous slurry as previously described. The commingling is executed at a low shear mixer 16 wherein temperatures are maintained in the range of approximately 120° to 140° F. and the average shear rate is less than 100 reciprocal seconds, more preferably approximately 20 to 50 reciprocal seconds. Commingling has been practiced at approximately 25 reciprocal seconds.

Preferably, the commingling of the dry ground tobacco particles 14 and the hydrated binder solution 12 proceeds in a ribbon blender or other such low shear mixing device as is commonly employed in the industry, with the relative proportions of the two components being selected such that the solids content of the ultimate mixture becomes 15 to 26%, and more preferably between about 18 to 22%, depending upon the relative proportion of stem to dust content in the starting feed stock of tobacco material. The presence of stem will tend to lower the operationally workable level of solids content. With this process being capable of operating with 100% dust (with little or no stem content), the solids content may be elevated to approximately 25% or more. The greater solids content lessens drying requirements of the ultimate sheet, thereby lowering costs and enhancing efficiencies.

Residence time in the low shear mixer 16 may range from about 10 minutes to about 2 hours and more preferably about 30 minutes to one hour. As with the high shear mixers 36 and 38, the temperature of the slurry at the low shear mixer 16 is to be maintained preferably about 120° F. to 140° F., but is not allowed to exceed 160° F. to avoid thermal degradation of the slurry.

Although it is preferred to produce the tobacco material 20 of the present invention without preservatives, such may be optionally added to the slurry produced at the low shear mixer 16. Such preservatives include propionates, carbonates, benzoates, and mixtures thereof. Potassium sorbate would be a particular preferred preservative.

Optionally, diammonium phosphate (DAP) may be added to slurry produced at the low shear mixer 16 for effecting a subjective note similar to a reconstituted sheet employing the DAP process, when the attributes of that other type of reconstituted sheet is to be mimicked. It is to be understood that the addition of DAP in this process is for flavoring purposes only and not for effecting the release pectin binders, although it might occur to some extent if this optional step is undertaken. The process works well and is preferred without the addition of DAP.

Another optional step is to further commingle the dry ground tobacco 14 and the shear-treated binder solution 12 by passing the output of the low shear mixer 16 through another a low shear mixer 44. One would incorporate the additional low shear mixer in a large process where additional surge capacity is needed to ensure slurry is never depleted from the casting box. Generally at higher line speeds the more surge capacity, the better or easier the process is to run from an operational standpoint. This arrangement allows for an easier and cheaper control strategy.

The next step in the process 10 includes directing the slurry output from the low shear mixer 16 into a casting box 46 that lays the slurry upon an endless steel belt 18. This casting step may be performed using a reverse roll coater or any other device known in the art for laying slurry material onto an endless belt. Preferably, the slurry is laid at a temperature of 120° to 140° F. and preferably no greater than 160° F. to avoid undesired degradation.

This casting step is performed at belt speeds ranging from about 20 to about 400 feet per minute, and more preferably from about 150 to 390 feet per minute. The endless steel belt 18 directs the cast slurry through a primary dryer 48 and optionally a secondary dryer 50, which are of conventional gas-fired and/or steamed heated designs as commonly employed in the tobacco industry. At the exit end of the endless belt 18, the dried sheet is doctored off the steel belt 18 and directed to a chevron cutter (or equivalent) for cutting the sheet product into pieces, preferably in the form of two to about six inches sguare pieces as a reconstituted tobacco product 20 suitable for inclusion in the manufacture of cigarettes or other tobacco products. It is to be understood that other cut sizes may be preferred depending upon the applications intended or the nature of the reconstituted tobacco material 20.

Not wishing to be bound by theory, it is believed that employment of the low shear mixer 16 to effect commingling of the shear-treated binder solution 12 with the dry ground tobacco 14 allows for gentle action between the two components so as not to disturb the super-hydrated state of the shear-treated binder solution 12, thereby enhancing the probability that the enhanced number of binder sites will cooperate with tobacco particles. The gentle action at the low shear mixer 16, together with the more complete hydration achieved at the second high shear mixture 38 and the avoidance of thermal degradation throughout the process, but particularly at the first and second mixers 36 and 38, contribute to greater binding and a stronger final sheet 20 as the following data will reveal.

COMPARATIVE EXAMPLES

For comparative purposes, a pilot plant was arranged to produce several runs of tobacco sheet for analytical purposes. In all runs, feedstock of tobacco particles comprised a blend of 67% production dust and 33% burley stem at a particle size of 120 mesh. The guar gum comprised 7 parts per 100 parts tobacco as is. Both TIC and Aqualon types of guar were used in the various runs, it having been discovered that choice of guar type generally did not affect final sheet strength. Commingled slurries were laid on an endless belt and dried using a gas fired, air impingement dryer.

The first series of runs having run numbers 1C through 7C utilize guar gum (galactomannan gum) which was dispersed in water at only a single high shear mixer before being cornmingled with a dry ground tobacco stock at a low shear mixer so as to produce a slurry of solids content in the range 20 to 22%. Glycerin was added at a weight-percent level of 2 to 4%. No amount of DAP was added to the slurry before it was laid and dried. The average shear rate at the singular mixer for the binder solution was approximately 100 reciprocal seconds.

In contrast, a second series of runs 8 through 15 were executed in accordance with the present invention, wherein ground guar gum was subjected to first and second high shearing action to produce a shear-treated hydrated binder which was commingled with a dry ground tobacco stock having a mean particle size in the range of 95% passage at 120 mesh. This shear-treated binder solution and dry ground tobacco were commingled in a low shear mixer and cast upon an endless belt and dried. Preparation of the binder solution included initially dispersing guar in a first high shear mixer while imparting an average shear rate of 100 to 200 reciprocal seconds and then hydrating the resultant guar dispersion in a Ross mixer for approximately one hour and twenty minutes at or near maximum settings (producing an average shear rate of approximately 600 to 800 reciprocal seconds).

The following Table is a compilation of the physical results, wherein the term "TEA" refers to the work done when a sample sheet is stressed to rupture in tension under prescribed conditions and are measured by the integral of the tensile stress over the range of tensile strain (zero to maximum strain). The TEA is expressed as energy per unit area (length times width) of the test sample. Significance is attached to tensile energy absorbance as being indicative of the durability of the cast sheet to repetitive straining or impact, such as occurs in primary processing of tobacco and cigarette making.

Measurements of TEA was performed using a Thwing-Albert Intelect-II-STD Tensile Tester Model No. 1451-24.

The equilibrated OV is the oven volatiles content of the sheet material after the sample has equilibrated at a temperature of 24° C. (75° F.) at 60% relative humidity for at least 48 hours.

TABLE

| Run No. | Dust Blend Total % | Stem % | Parts Guar | Eq OV % | TEA g/cm/cm$^2$ | Tensile kg/m | Weight g/ft$^2$ |
|---|---|---|---|---|---|---|---|
| 1C | 67 | 33 | 7 | 13.43 | 1.3 | 11.93 | 12.29 |
| 2C | 67 | 33 | 7 | 13.69 | 1.42 | 13.36 | 14.06 |
| 3C | 67 | 33 | 7 | 13.68 | 1.47 | 14.84 | 14.22 |
| 4C | 67 | 33 | 7 | 12.11 | 1.22 | 16.38 | 14.71 |
| 5C | 67 | 33 | 7 | 12.16 | 1.3 | 14.82 | 14.81 |
| 6C | 67 | 33 | 7 | 12.79 | 1.01 | 11.52 | 13.82 |
| 7C | 67 | 33 | 7 | 12.09 | 0.88 | 10.02 | 15.29 |
| | | | average | 12.85 | 1.23 | 13.27 | 14.17 |
| 8 | 67 | 33 | 7 | 13.52 | 3.74 | 22.78 | 14.26 |
| 9 | 67 | 33 | 7 | 12.13 | 3.43 | 26.58 | 13.48 |
| 10 | 67 | 33 | 7 | 11.94 | 2.02 | 23.01 | 15.36 |
| 11 | 67 | 33 | 7 | 11.97 | 2.86 | 27.92 | 14.90 |
| 12 | 67 | 33 | 7 | 12.14 | 1.74 | 21.44 | 13.74 |
| 13 | 67 | 33 | 7 | 13.05 | 2.69 | 22.08 | 14.67 |
| 14 | 67 | 33 | 7 | 12.76 | 2.2 | 20.09 | 13.83 |
| 15 | 67 | 33 | 7 | 12.57 | 2.61 | 22.45 | 14.5 |
| | | | average | 12.51 | 2.66 | 23.29 | 14.34 |

From the above Table, its readily apparent that the practice of the present invention in the construction of a reconstituted tobacco material 20 achieves greatly improved TEA and tensile strength over prior practices.

In further comparison, it may be generally characterized that a reconstituted sheet produced using the DAP process as previously described will offer a sheet having a tensile strength of about 15 kilograms per meter. The present process 10 achieves a far stronger sheet while not employing additives such as diammonium phosphate for effecting binding of the tobacco particles. Accordingly, the present process 10 and the sheet 20 produced thereby contributes a stronger sheet without the alteration of its tobacco taste from DAP.

ADDITIONAL EXAMPLES

Example I 55.5 pounds of TIC SCM guar gum was dispersed into 385 gallons of water at 120° F. in a high shear mixer. Since this is a slower hydrating gum, the guar solution was mixed for 1 hour to ensure adequate dispersion before sending the solution to a second high shear mixer (Ross mixer) and allowed to hydrate for 1 hour and 20 minutes. Prior to pumping the guar dispersion to the second high shear mixer, 19.8 pounds of glycerine (to yield 4% in final sheet on a dry weight basis) and 48 pounds of sweetener (to yield 4% in final sheet on a dry weight basis) were added to the guar dispersion. The preferable method would have been to add the humectant and sweetener in the second high shear mixer. The temperature of the guar solution did not exceed 140° F.

100% production dust (no stem) with a particle size of 95% at less than 120 mesh was mixed with the sheared guar solution in a low shear mixer (ribbon blender) at a ratio to produce a slurry with a solids content of 22.5% to 23.5% (the guar solution/tobacco dust ratio was targeted for 21%). The residence time in the ribbon blender was approximately 30 minutes, with a temperature of approximately 135° to 140° F. The slurry was then cast onto a stainless steel belt using a reverse-roll coater, although a casting box would have been the preferable method of casting. The line speed was 30 fpm. The slurry was dried in a gas-fired air impingement dryer. The exiting moisture from the secondary dryer was approximately 15%. The final sheet, after equilibration for 48 hours, had a tensile strength of 18.19 kg/m at a final equilibrated OV of 12.04%, a TEA of 2.43 g/cm/cm2 and a sheet weight of 11.60 g/ft2. This sheet is below the desired tensile strength for cast leaf of 20 kg/m, but is still above the 15 kg/m tensile strength achieved by the diammonium phosphate-ammonia process. The reason for the slightly lower than desired tensile strength was because the actual guar solution was made for a target slurry solids of 21%, but the actual slurry solids content was higher, thus giving a lower than expected guar level in the final sheet, approximately 4% instead of the expected 6.3%. Additionally, the sheet weight is lower than a target of 12.5 g/ft2. A higher sheet weight would have yielded a stronger sheet. With adjustments of guar content and sheet weight, tensile strengths of 20 kg/m are obtainable with 100% dust feedstock (little or no stem).

Example II 54.76 pounds of TIC SCM guar gum was dispersed into 383 gallons of water at 75° F. in a high shear mixer. With this slower hydrating gum, the guar solution was mixed for 1 hour to ensure adequate dispersion before the solution was sent to a second high shear mixer (Ross mixer) and allowed to hydrate for 1 hour and 20 minutes. Prior to pumping the guar dispersion to the second high shear mixer, 25 pounds of glycerine (to yield 4% in final sheet on a dry weight basis) and 44 pounds of sweetener (to yield 4% in final sheet on a dry weight basis) were added to the guar dispersion. The preferable method would have been to add the humectant and sweetener in the second high shear mixer. The temperature of the guar solution was kept at approximately 120° F.

A 70% production dust and 30% burley stem tobacco mixture with a particle size of 95% at less than 120 mesh was mixed with the sheared guar solution in a low shear mixer (ribbon blender) at a ratio to produce a slurry with a solids content of approximately 21%. The residence time in the ribbon blender was approximately 30 minutes, with a temperature of approximately 120° to 135° F. The slurry was then cast onto a stainless steel belt using a reverse-roll coater, although a casting box would have been the preferable method of casting. The line speed was 30 fpm. The slurry was dried in a gas-fired, air impingement dryer. The exiting moisture from the secondary dryer was approximately 15%. The final sheet, after equilibration for 48 hours, had an average tensile strength of 29.15 kg/m (+/–2.9 kg/m), an average equilibrated OV of 12.78% (+/–0.13%), an average TEA of 3.52 g/cm/cm2 (+/–0.57 g/cm/cm$^2$) and an average sheet weight of 13.79 g/ft$^2$ (+/–0.07).

Example III 35.37 pounds of Aqualon G2 guar gum was educted with 289 gallons of water at 75° F. at the proper ratio to avoid agglomeration into a first high shear mixer. With this faster hydrating gum, the guar solution was mixed for 15 minutes after the eduction was completed to ensure adequate dispersion before the solution was sent to a second high shear mixer (Ross mixer) and allowed to hydrate for 30 minutes. Prior to pumping the guar dispersion to the second high shear mixer, 20.6 pounds of glycerine (to yield 4% in final sheet on a dry weight basis) and 30.9 pounds of isosweet (to yield 4% in final sheet on a dry weight basis) were added to the guar dispersion. The preferable method would have been to add the humectant and sweetener in the second high shear mixer. The temperature of the guar solution was kept at approximately 120° F.

A mixture of 50% production dust, 30% bright stem and 20% burley stem at a particle size of 95% at less than 120 mesh was mixed with the sheared guar solution in a low shear mixer (ribbon blender) at a ratio to produce a slurry with a solids content of approximately 18% to 18.5%. The residence time in the ribbon blender was approximately 30 minutes, with a temperature of approximately 120° to 135° F. The slurry was then cast onto a stainless steel belt using a reverse-roll coater, although a casting box would have been the preferable method of casting. The line speed was 30 fpm. The slurry was dried in a gas-fired, air impingement dryer. The exiting moisture from the secondary dryer was approximately 15%. The final sheet, after equilibration for 48 hours, had an average tensile strength of 23.67 kg/m (+/–1.01 kg/m), an average equilibrated OV of 13.25% (+/–0.14%), an average TEA of 11.77 g/cm/cm2 (+/–1.97 g/cm/cm2) and an average sheet weight of 14.6 g/ft2 (+/–0.89).

Although it is preferred to practice the present invention without any wood pulp content, even further enhancement in sheet strength (tensile and TEA) may be achieved by the inclusion of wood pulp fiber. With add-on levels of wood pulp fiber in the range of 0.5 to 2% by weight, tensile strengths of 30 to 40 kilograms per meter or more may be achieved. However, the effects of wood pulp fiber on taste of a cigarette can be detected by some discerning smokers even at levels as low as 0.5% by weight. Accordingly, it may be a preferred practice to construct a sheet of tobacco material in accordance with the process 10, with the addition of wood pulp fiber at a level achieving 0.5% by weight of the sheet material or less, more preferably 0.25% by weight or less. Such practices can achieve tobacco sheet material whose binder consists essentially of a polysaccharide binder such guar gum, with tensile strengths of well above 20 kilograms per meter, but with wood pulp fiber content at levels that are subjectively acceptable and/or subjectively benign (less than 0.5% by weight).

While this invention has been illustrated and described in accordance with preferred embodiments, it is recognized that variations and changes may be made therein without departing from the invention as set forth in the claims. For example, preparation of hydrated binder solution can be pursued using only a single high shear mixing device, with the device being adapted to operate in a first shearing mode for achieving dispersion of the binder and a second shearing mode for achieving hydration of the dispersed binder. However production efficiencies and design considerations favor the use of two high shear mixers.

What is claimed is:

1. A process of making a reconstituted tobacco material of constituents essentially limited to tobacco, a gum binder and a humectant, said process comprising the steps of:

(a) dispersing a binder in water under a first shear sufficient to form an aqueous binder dispersion, said binder consisting essentially of a gum;

(b) hydrating said aqueous binder dispersion of step (a) by subjecting the aqueous binder dispersion to a second shear so as to produce a hydrated binder solution;

(c) commingling tobacco particles with said hydrated binder solution of step (b) under a low shear so as to form a slurry, said low shear at a shear rate of less than 100 reciprocal seconds;

(d) casting the slurry; and (e) drying the cast slurry to form a reconstituted tobacco material.

2. The process as claimed in claim 1, wherein said first and second shears are each at an average shear rate in the range of approximately 100 to 1000 reciprocal seconds, said second shear being at a greater average shear rate than said first shear.

3. The process as claimed in claim 2, wherein the first shear of step (a) is at an average shear rate in the range of approximately 100 to 500 reciprocal seconds.

4. The process as claimed in claim 3, wherein the first shear of step (a) is at an average shear rate in the range of approximately 100 to 300 reciprocal seconds.

5. The process as claimed in claim 4, wherein said second shear of step (b) is at an average shear rate in the range of approximately 600 to 800 reciprocal seconds.

6. The process as set forth in claim 5, wherein said binder comprises guar gum.

7. The process as claimed in claim 6, wherein the tobacco particles have a particle size of approximately 80 mesh or finer.

8. The process as claimed in claim 6, wherein the tobacco particles have a particle size of approximately 120 mesh or finer.

9. The process as claimed in claim 6 further comprising the step of adding a humectant at a level of 2 to 4 percent by weight of the reconstituted tobacco material.

10. A reconstituted tobacco material constructed by the process set forth in claim 6, said reconstituted tobacco material having a tensile strength greater than 20 and binder consisting essentially of guar.

11. The process as claimed in claim 5, wherein said commingling step is performed at an average shear rate in the range of approximately 20 to 50 reciprocal seconds.

12. The process as claimed in claim 3, wherein the first shear of step (a) achieves a viscosity in said dispersion in the range of approximately 2 to 6 poise.

13. The process as claimed in claim 12, wherein the second shear of step (b) achieves a viscosity in said binder solution in the range of approximately 20 to 60 poise.

14. The process as claimed in claim 3, wherein said second shear of step (b) is at an average shear rate in the range of approximately 500 to 1000 reciprocal seconds.

15. The process as claimed in claim 14, wherein said hydrating step (b) includes removing heat so that the temperature of the binder solution remains below 170° F.

16. The process as set forth in claim 15, wherein temperature of the binder solution is maintained in the range of approximately 120° to 140° F.

17. The process as claimed in claim 14, wherein the tobacco particles have a particle size of approximately 80 mesh or finer.

18. The process as claimed in claim 14, wherein the tobacco particles have a particle size of approximately 120 mesh or finer.

19. The process as claimed in claim 14, wherein the binder is selected from the group consisting of fruit pectin, citrus pectin, tobacco pectin, hydroxyethyl guar gum, hydroxypropyl guar gum, hydroxyethyl locust bean gum, hydroxypropyl locust bean gum, alginate, starch, modified starch, derivitized starch, tamarind gum, dextran, pullalon, konjac flour, xanthan gum, and mixtures thereof; and said tobacco particles having a particle size of 80 mesh or finer.

20. The process as claimed in claim 14, wherein said tobacco particles comprise at least one of tobacco dust, tobacco stem and stemmery discard or a combination thereof.

21. The process as claimed in claim 14, wherein said tobacco particles consists essentially of tobacco dust.

22. The process as claimed in claim 14, wherein said commingling step is performed at an average shear rate in the range of approximately 20 to 50 reciprocal seconds.

23. The process as claimed in claim 3, wherein said second shear of step (b) is at an average shear rate in the range of approximately 600 to 900 reciprocal seconds.

24. The process as claimed in claim 1, wherein the binder is selected from the group consisting of fruit pectin, citrus pectin, tobacco pectin, hydroxyethyl guar gum, hydroxypropyl guar gum, hydroxyethyl locust bean gum, hydroxypropyl locust bean gum, alginate, starch, modified starch, derivitized starch, tamarind gum, dextran, pullalon, konjac flour, xanthan gum, and mixtures thereof.

25. The process as claimed in claim 1, wherein the tobacco particles have a particle size of approximately 80 mesh or finer.

26. The process as claimed in claim 1, wherein the tobacco particles have a particle size of approximately 120 mesh or finer.

27. The process as claimed in claim 1 further comprising the step of adding a humectant at a level of 2 to 4 percent by weight of the reconstituted tobacco material.

28. The process as claimed in claim 1, wherein said tobacco particles comprise at least one of tobacco dust, tobacco stem and stemmery discard or a combination thereof.

29. The process as claimed in claim 1, wherein said tobacco particles consists essentially of tobacco dust.

30. A reconstituted tobacco material constructed by the process set forth in claim 1, said reconstituted tobacco material having a tensile strength of at least 20 kilograms per meter at an average sheet weight of approximately 14.3 g/ft$^2$ and with binder consisting essentially of guar.

31. A reconstituted tobacco material constructed by the process set forth in claim 1, said reconstituted tobacco material having a tensile strength of at least 20 kilograms per meter and binder consisting essentially of guar gum, said tobacco material having a maximum wood pulp fiber content of one-half percent by weight of the tobacco material or less.

32. The reconstituted tobacco material as claimed in claim 31 having a maximum wood pulp fiber content less than 0.25% by weight of the tobacco material.

33. The process as claimed in claim 1, wherein said gum consists essentially of guar gum, said first shear of step (a) being at an average shear rate in the range of approximately 100 to 300 reciprocal seconds, said second shear of step (b) being at an average shear rate in the range of approximately 600 to 800 reciprocal seconds.

34. A process of making a reconstituted tobacco material, said process comprising the steps of:

(a) preparing an aqueous binder dispersion by mixing a water-soluble polysaccharide binder under a first shear sufficient to disperse the binder to form an aqueous binder dispersion;

(b) hydrating said aqueous binder dispersion of step (a) by subiecting the aqueous binder dispersion to a second shear so as to produce a hydrated binder solution;

(c) commingling tobacco particles with said hydrated binder solution of step (b) under a low shear so as to form a slurry;

(d) casting the slurry; and (e) drying the cast slurry to form a reconstituted tobacco material;

wherein said polysaccharide binder comprises guar gum;

wherein said second shear of step (b) is at an average shear rate in the range of approximately 600 to 800 reciprocal seconds;

wherein the first shear of step (a) is at an average shear rate in the range of approximately 100 to 500 reciprocal seconds;

wherein the low shear of the commingling step (c) is at an average rate of about 100 reciprocal seconds or less;

wherein said hydrating step (b) includes removing heat so that the temperature of the binder solution remains below 170° F.

35. The process as set forth in claim 34, wherein temperature of the binder solution is maintained in the range of approximately 120° to 140° F.

36. A process of making a reconstituted tobacco material, said process comprising the steps of:

(a) combining water and a gum binder and applying a first shear to said combined water and gum binder at an average shear rate of approximately 100 to 500 reciprocal seconds, said first shear applying step sufficient to disperse the binder to form an aqueous binder dispersion;

(b) hydrating said aqueous binder dispersion of step (a) by subjecting the aqueous binder dispersion to a second shear at an average shear rate of approximately 500 to 1000 reciprocal seconds so as to produce a hydrated binder solution;

(c) commingling tobacco particles of approximately 80 mesh size or finer with said hydrated binder solution of step (b) under a low shear at an average shear rate of approximately 100 reciprocal seconds or less so as to form an essentially homogeneous slurry, relative proportions of said tobacco particles and said hydrated binder solution of step (b) being selected such that the solids content of said slurry is in the range of approximately 15 to 26%;

(d) casting the slurry; and (e) drying the cast slurry to form a reconstituted tobacco material.

37. The process as claimed in claim 36, wherein said tobacco particles comprise at least one of tobacco dust, tobacco stem and stemmery discard or a combination thereof.

38. The process as claimed in claim 37, wherein said solids content of the slurry is in the range of approximately 18 to 22%.

39. The process as claimed in claim 36, wherein said tobacco particles consists essentially of tobacco dust.

40. The process as claimed in claim 39, wherein said solids content of the slurry is above 22%.

41. The process as claimed in claim 36, wherein said commingling step is performed at an average shear rate in the range of approximately 20 to 50 reciprocal seconds.

42. A process of making a reconstituted tobacco material, said process comprising the steps of:

combining water and a gum binder and applying a first shear to said combined water and gum binder at an average shear rate of approximately 100 to 500 reciprocal seconds, said first shear applying step sufficient to disperse the binder to form an aqueous binder dispersion;

(b) hydrating said aaueous binder dispersion of step (a) by subjecting the aqueous binder dispersion to a second shear at an average shear rate of approximately 500 to 1000 reciprocal seconds so as to produce a hydrated binder solution;

(c) commingling tobacco particles of approximately 80 mesh size or finer with said hydrated binder solution of step (b) under a low shear at an average shear rate of approximately 100 reciprocal seconds or less so as to form an essentially homogeneous slurry, relative proportions of said tobacco particles and said hydrated binder solution of step (b) being selected such that the solids content of said slurry is in the range of approximately 15 to 26%;

(d) casting the slurry; and (e) drying the cast slurry to form a reconstituted tobacco material;

wherein said hydrating step (b) includes removing heat so that the temperature of the binder solution remains below 170° F.

43. The process as claimed in claim 42, wherein said gum consists essentially of guar gum, said first shear of step (a) being at an average shear rate in the range of approximately 100 to 300 reciprocal seconds, said second shear of step (b) being at an average shear rate in the range of approximately 600 to 800 reciprocal seconds.

44. The process as claimed in claim 43, wherein said tobacco particles are of approximately 120 mesh size or finer.

45. The process as claimed in claim 43, wherein said commingling step is performed at an average shear rate in the range of approximately 20 to 50 reciprocal seconds.

46. A process of making a reconstituted tobacco material, said process comprising the steps of:

(a) preparing an aqueous binder dispersion by mixing a water-soluble polysaccharide binder under a first shear sufficient to disperse the binder to form an aqueous binder dispersion;

(b) hydrating said aqueous binder dispersion of step (a) by subjecting the aqueous binder dispersion to a second shear so as to produce a hydrated binder solution;

(c) commingling tobacco particles with said hydrated binder solution of step (b) under a low shear so as to form a slurry;

(d) casting the slurry; and (e) drying the cast slurry to form a reconstituted tobacco material;

wherein the first shear of step (a) is at an average shear rate in the range of approximately 100 to 300 reciprocal seconds;

wherein the first shear of step (a) forms an aqueous binder dispersion having a solids content of in the range of approximately 1.5% to 1.8% by weight and having a temperature of approximately 120° F.

* * * * *